US005655973A

United States Patent [19]

McPherson, Jr.

[11] Patent Number: 5,655,973

[45] Date of Patent: Aug. 12, 1997

[54] LASER GOLF TRAINING DEVICE

[76] Inventor: Paul A. McPherson, Jr., 1251 Sweisford Rd., Perkiomehville, Pa. 18074

[21] Appl. No.: 728,975

[22] Filed: Oct. 11, 1996

[51] Int. Cl.[6] ..... A63B 69/36

[52] U.S. Cl. ..... 473/220; 473/299

[58] Field of Search ..... 473/220, 299

[56] References Cited

U.S. PATENT DOCUMENTS

| | | | |
|---|---|---|---|
| 4,693,479 | 9/1987 | Mc Gwire | 473/220 |
| 4,913,441 | 4/1990 | Freer | 473/220 |
| 5,544,888 | 8/1996 | Pellegrini | 473/220 |

*Primary Examiner*—George J. Marlo

[57] ABSTRACT

A golf training device comprising, in combination:

a golf club having a shaft with a club head portion situated on a first end thereof and an elastomeric handle positioned on a second end thereof, the club further having a cylindrical axial bore formed in the second end thereof and which is accessible from the second end, wherein the bore is of a predetermined length and diameter; and a laser emitting device including a first mounting portion with a cylindrical configuration having a size, length and shape consistent with that of said bore for being releasably fixed therein, and a second portion integrally formed in axial relation with the first portion with a cylindrical configuration along a majority of its extent and a frusto-conical configuration along the remainder of its extent, the frusto-conical extent including a flange defined by a radially extending portion extending laterally beyond and adjacent the first portion of the device and a beveled outer surface portion extending from the outer periphery of the radially extending portion to a point a distance away from the first portion which is a small fraction of the length of the second portion. The length of the second portion is between 50% and 75% of the predetermined length. The total length of the laser emitting device is between 3 and 6 inches. The radial portion of the flange is flush with the second of the club when the laser emitting device is secured in the bore.

1 Claim, 2 Drawing Sheets

LASER GOLF TRAINING DEVICE

BACKGROUND OF THE INVENTION.

1. Field of the Invention

The present invention relates to a laser golf training device and more particularly pertains to providing a uniquely configured laser emitting device which can be easily retrofitted within a conventional golf club to allow the tracking of a plane of a user's golf swing.

2. Description of the Prior Art

The use of golf training devices is known in the prior art. More specifically, golf training devices heretofore devised and utilized for the purpose of enhancing a user's golf swing are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,913,441 to Freer; U.S. Pat. No. 4,693,479 to McGwire; U.S. Pat. No. 5,435,562 to Stock et al.; U.S. Pat. No. 5,193,812 to Hendricksen; U.S. Pat. No. 5,161,802 to Daechsel; and U.S. Pat. No. 5,167,415 to Iandola.

In this respect, the laser golf training device according to the present invention substantially departs from the conventional concepts and designs of the prior art, and in so doing provides an apparatus primarily developed for the purpose of providing a uniquely configured laser emitting device which can be easily retrofitted within a conventional golf club to allow the tracking of a plane of a user's golf swing.

Therefore, it can be appreciated that there exists a continuing need for a new and improved laser golf training device which can be used for providing a uniquely configured laser emitting device which can be easily retrofitted within a conventional golf club to allow the tracking of a plane of a user's golf swing. In this regard, the present invention substantially fulfills this need.

SUMMARY OF THE INVENTION

In view of the foregoing disadvantages inherent in the known types of golf training devices now present in the prior art, the present invention provides an improved laser golf training device. As such, the general purpose of the present invention, which will be described subsequently in greater detail, is to provide a new and improved laser golf training device which has all the advantages of the prior art and none of the disadvantages.

To attain this, the present invention essentially comprises a golf club having a shaft with a club portion situated on a first end thereof and an elastomeric handle positioned on a second end thereof. The club further has a cylindrical axial bore formed in the second end thereof. Such bore is accessible from the second end. As shown in FIGS. 2–4, a laser emitting device is provided. The laser emitting device has a first portion with a cylindrical configuration having a size, length and shape consistent with that of the bore. A second portion is integrally formed in axial relation with the first portion with a cylindrical configuration along a majority of its extent. The second portion includes a flange integrally formed therewith having a generally frusto-conical configuration. The flange is defined by a radial extending portion formed adjacent the first portion of the device and a beveled portion. As best shown in FIGS. 2 and 4, the beveled portion extends from an outer periphery of the radial extending portion to a point a distance away from the first portion which is 10% the length of the second portion. It should be noted that the length of the second portion is between 50% and 75% of a length of the bore and first portion. Further provided as a component of the laser emitting device is a disk-shaped lens formed on an end of the second portion opposite the flange. An actuator switch is positioned on a central extent of the second portion. In operation, the switch has a first orientation for transmitting an activation signal and a second orientation for transmitting a deactivation signal. Upon the receipt of the activation signal, the laser emitting device is adapted to emit a laser through the lens which resides along an axis of the device.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved laser golf training device which has all the advantages of the prior art golf training devices and none of the disadvantages.

It is another object of the present invention to provide a new and improved laser golf training device which may be easily and efficiently manufactured and marketed.

It is a further object of the present invention to provide a new and improved laser golf training device which is of a durable and reliable construction.

An even further object of the present invention is to provide a new and improved laser golf training device which is susceptible of a low cost of manufacture with regard to both materials and labor, and which accordingly is then susceptible of low prices of sale to the consuming public, thereby making such laser golf training device economically available to the buying public.

Still yet another object of the present invention is to provide a new and improved laser golf training device which provides in the apparatuses and methods of the prior art some of the advantages thereof, while simultaneously overcoming some of the disadvantages normally associated therewith.

Still another object of the present invention is to provide a uniquely configured laser emitting device which can be easily retrofitted within a conventional golf club to allow the tracking of a plane of a user's golf swing.

Lastly, it is an object of the present invention to provide a new and improved laser golf training device including a golf club having a shaft with a club portion situated on a first end thereof and an elastomeric handle positioned on a second end thereof. The club further has a bore formed in the second end thereof. Further provided is a laser emitting device adapted to be inserted within the bore of the golf club. The laser emitting device is adapted to emit a laser which resides along an axis of the device for allowing a user to track a plane of the user's swing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
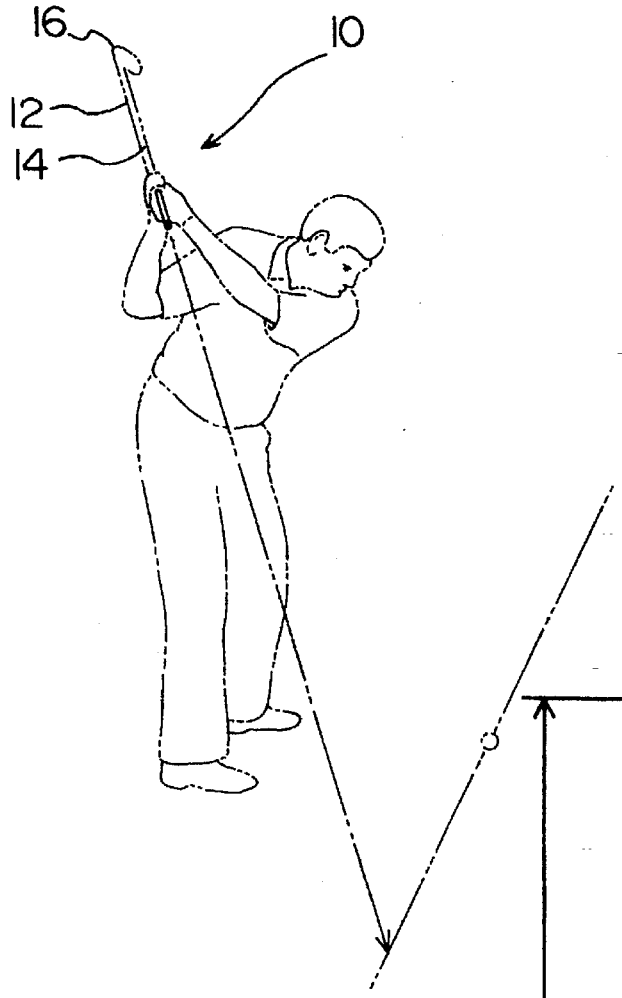
FIG. 1 is a perspective illustration of the preferred embodiment of the laser golf training device constructed in accordance with the principles of the present invention.

With reference now to the drawings, and in particular to FIG. 1 thereof, a new and improved laser golf training device embodying the principles and concepts of the present invention and generally designated by the reference numeral 10 will be described.

The present invention, the new and improved laser golf training device, is comprised of a plurality of components. Such components in their broadest context include a golf club and a laser emitting device. Such components are individually configured and correlated with respect to each other so as to attain the desired objective.

More specifically, it will be noted that the system 10 of the present invention includes a golf club 12 having a shaft 14 with a club head portion situated on a first end 16 thereof and an elastomeric handle positioned on a second end thereof. The club further has a cylindrical axial bore 18 formed in the second end thereof. Such bore is accessible from the second end of the golf club. The bore is of a predetermined length and has a diameter of approximately ¼ inch.

Figure 2:
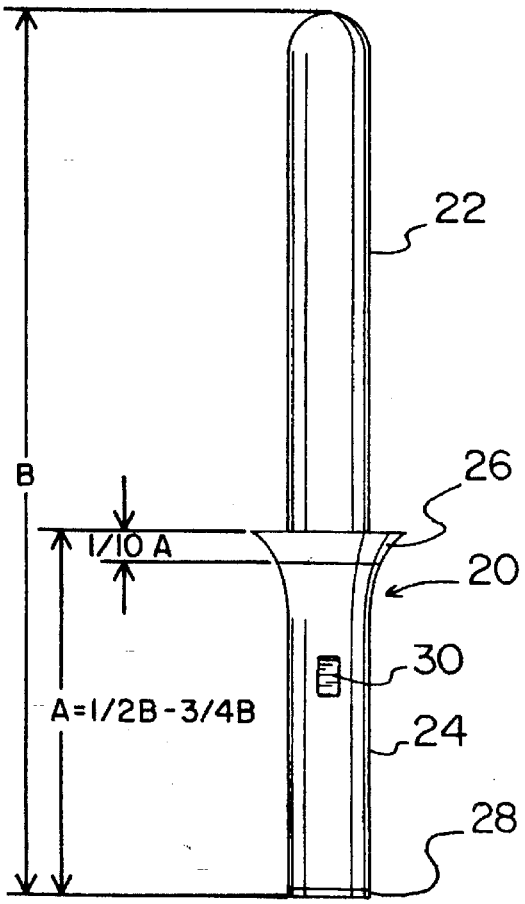
FIG. 2 is a front elevational view of the present invention.
Figure 5:
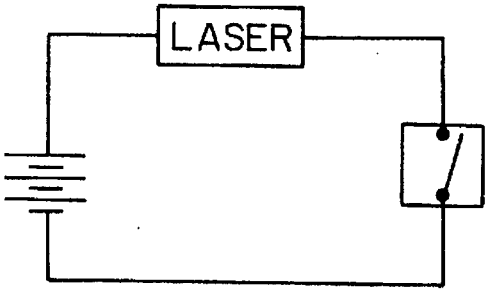
FIG. 5 shows the components associated with the laser emitting device.
Figure 4:
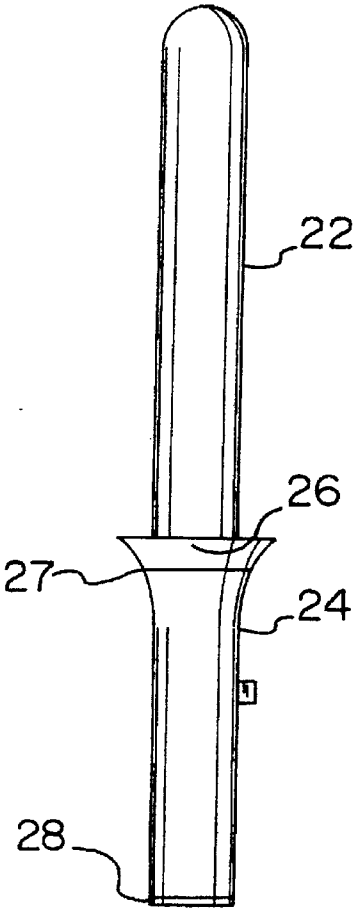
FIG. 4 is a side elevational view of the present invention.
Figure 3:
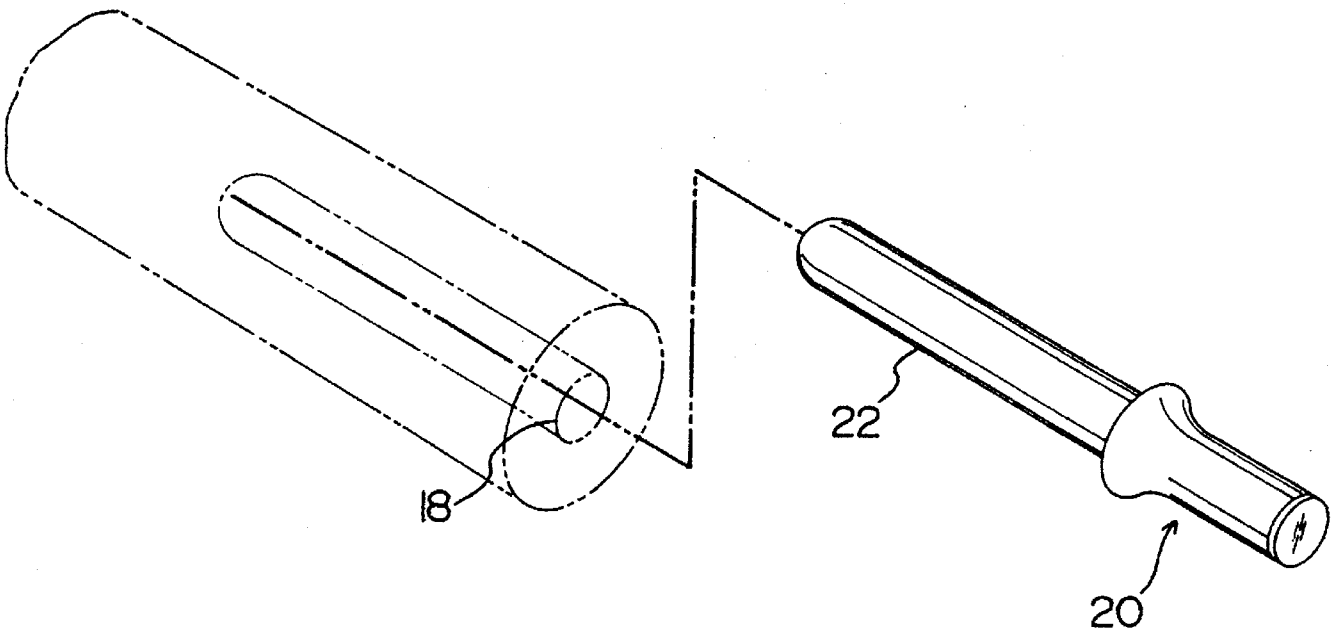
FIG. 3 is a perspective view showing the method of inserting the second portion of the laser emitting device within the bore.

As shown in FIGS. 2–4, a laser emitting device 20 is provided. Plastic or metal may be employed in constructing the laser emitting device. The laser emitting device has a first portion 22 with a cylindrical configuration having a size, length and shape consistent with that of the bore. A second portion 24 is integrally formed in axial relation with the first portion with a cylindrical configuration along a majority of its extent. The second portion includes a flange 26 integrally formed therewith having a generally frusto-conical configuration. As such, the flange is defined by a radial extending portion formed adjacent the first portion of the device and a beveled portion. As best shown in FIGS. 2 and 4, the beveled portion extends from an outer periphery of the radial extending portion to a point 27 a distance away from the first portion which is 10% the length of the second portion. It should be noted that the length of the second portion is between 50% and 75% the predetermined length. It should also be noted that the total length of the laser emitting device is between approximately 3–6 inches.

Further provided as a component of the laser emitting device is a disk-shaped lens 28 formed on an end of the second portion opposite the flange. An actuator switch 30 is positioned on a central extent of the second portion. In operation, the switch has a first orientation for transmitting an activation signal and a second orientation for transmitting a deactivation signal. The laser emitting device is adapted to emit a laser through the lens which resides along an axis of the device upon the receipt of the activation signal. Ideally, the laser emitting device is powered by a watch battery and has weight such that the original balance of the club is not altered.

By this structure, the first portion of the laser emitting device may be inserted within the bore of the golf club for allowing a user to track a plane of the user's swing. When inserted, the radial portion of the flange abuts the second end of the golf club and is flush therewith. It should be noted that a plurality of such devices may be provided with each fixed within a respective club or the device may be releasably situated within a plurality of golf clubs each having a bore formed therein. Also, as an option, the laser emitting device may be adapted to emit the laser only upon the golf club being held in an inverted orientation, thereby only providing a laser beam when required.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved laser golf training device comprising, in combination:

a golf club having a shaft with a club head portion situated on a first end thereof and an elastomeric handle positioned on a second end thereof, the club further having a cylindrical axial bore formed in the second end thereof and which is accessible from the second end, wherein the bore is of a predetermined length and diameter; and a laser emitting device including a first mounting portion with a cylindrical configuration having a size, length and shape consistent with that of said bore for being releasably fixed therein and a second portion integrally formed in axial relation with the first portion with a cylindrical configuration along a majority of its extent and a frusto-conical configuration along the remainder of its extent, the frusto-conical extent including a flange integrally formed therewith and defined by a radially extending portion extending laterally beyond and adjacent the first portion of the device and a beveled outer surface portion extending from the outer periphery of the radially extending portion to a point a distance away from the first portion which is a minor fraction of the length of the second portion, wherein the length of the second portion is between 50% and 75% of said predetermined length, the laser emitting device further having a disk-shaped lens formed on an end of the second portion thereof opposite the flange and an actuator switch positioned on a central extent of the second portion having a first orientation for transmitting an activation signal and a second orientation for transmitting a deactivation signal, the laser emitting device adapted to emit a laser through the lens which resides along an axis of the device upon the receipt of the activation signal, wherein the total length of the laser emitting device is between 3 and 6 inches;

whereby the first portion of the laser emitting device may be inserted within the bore of the golf club with the radial portion of the flange flush with the second end thereof for allowing a user to track a plane of the user's swing.

* * * * *